US005269952A

United States Patent [19]

Proffitt, Jr.

[11] Patent Number: 5,269,952

[45] Date of Patent: Dec. 14, 1993

[54] ANTISTATIC FINISH FOR DYEABLE SURFACTANT-CONTAINING POLY(M-PHENYLENE ISOPHTHALAMIDE) FIBERS

[75] Inventor: Thomas J. Proffitt, Jr., Kinston, N.C.

[73] Assignee: E. I. Du Pont de Nemours and Company, Wilmington, Del.

[21] Appl. No.: 995,513

[22] Filed: Dec. 21, 1992

[51] Int. Cl.[5] ..... D06M 11/00; D06M 15/00

[52] U.S. Cl. ..... 252/8.8; 252/8.6; 252/8.9; 8/115.64

[58] Field of Search ..... 8/115.64; 252/8.6–8.9

[56] References Cited

U.S. PATENT DOCUMENTS 2,516,980 8/1950 Gray et al. ..... 260/45.7
2,691,567 10/1954 Kualnes et al. ..... 8/115.5
3,422,796 1/1969 Baber ..... 118/411
3,597,265 8/1971 Mecklenburg et al. ..... 117/126 GR
3,816,321 6/1974 Kleinschmidt ..... 252/134
3,844,952 10/1974 Booth ..... 252/8.75
4,256,800 3/1981 Stockhausen et al. ..... 428/245
4,668,234 5/1987 Vance et al. ..... 8/115.6
4,985,046 1/1991 Hartzler ..... 8/654

FOREIGN PATENT DOCUMENTS 330315 8/1991 Japan .

*Primary Examiner*—Paul Lieberman
*Assistant Examiner*—Michael Tierney

[57] ABSTRACT

A combination of potassium $C_6$ to $C_{18}$ alkyl phosphate and partially amidated polyalkyleneimine reduces the static propensity of substantially amorphous poly(m-phenylene isophthalamide) fiber containing surfactant.

4 Claims, No Drawings

ANTISTATIC FINISH FOR DYEABLE SURFACTANT-CONTAINING POLY(M-PHENYLENE ISOPHTHALAMIDE) FIBERS

BACKGROUND OF THE INVENTION

U.S. Pat. No. 4,668,234 discloses the production of oriented, substantially amorphous poly(m-phenylene isophthalamide) fibers containing a surfactant in an amount sufficient to enable the fiber to be dyed a deep shade. These fibers have very open structures which permit dyes to enter the fiber. Application of conventional antistatic finishes to such fibers leaves something to be desired since there is a loss of protection from electrostatic charging with age. This results in a deterioration of carding and drawing performance in the conversion of staple fibers to yarns and fabrics. The loss of protection after a month or two of storage makes it difficult if not impossible to control inventories and shipping times to provide customers with fibers which process without undesirable static.

The present invention seeks to overcome the aforementioned deficiency to a significant degree.

SUMMARY OF THE INVENTION

The present invention provides a surfactant-containing, substantially amorphous poly(m-phenylene isophthalamide) fiber of reduced static propensity having on its surface a two-component coating comprising from 65 to 90% by weight of potassium $C_6$–$C_{18}$ alkyl phosphate and from 10 to 35% by weight of a partially amidated polyalkyleneimine, said coating being present in an amount of at least about 0.2% based on the weight of the fiber.

DETAILED DESCRIPTION OF THE INVENTION

The filaments to be treated in accordance with the present invention are described in U.S. Pat. No. 4,668,234. More particularly they are fibers of poly(m-phenylene isophthalamide) MPD-I which have been dried after inhibition of from about 5 to 15% by weight of a surfactant as described in Example 1 part C, appearing at the top of column 8 of said patent.

To the dried MPD-I fibers described above is applied a coating of two active components. One of the components is a partially amidated polyalkyleneimine having a residual amine value of from about 200 to 800 as described in U.S. Pat. No. 3,597,265. It is formed by reacting a polyalkyleneimine having a molecular weight of 800 to about 5000 with a fatty acid. In the Examples which follow, polyethyleneimine having an average molecular weight of about 1200 was the polyalkyleneimine which was partially amidated with fatty acid as described in Examples 1–4 of said U.S. Pat. No. 3,597,265. The other active component of the antistatic finish of the invention is the potassium salt of an alkyl phosphate of which the alkyl group is 6 to 18 carbon atoms in length. Potassium n-octyl phosphate is preferred.

The two active components, namely, the partially amidated polyalkyleneimine and the phosphate salt can be applied to the fiber as an aqueous mixture or sequentially first the imine, then the phosphate (with drying between applications).

The resulting coating should contain the components in the proportion of 65 to 90 weight percent of the phosphate salt to 10 to 35 weight percent of partially amidated polyalkyleneimine. An aqueous solution of the components is applied to the fiber in an amount sufficient so that at least about 0.2% and preferably at least 0.4% of the active component coating is deposited, based on the weight of fiber. Amounts of up to 0.9% of the mixture can be used, however the minimum effective amount will normally be employed because of cost and because fouling of equipment is more likely to occur with use of excessive amounts. It is important that the fiber be dried shortly after application of the antistatic finish since diminished protection is noted where the fiber is allowed to dry under ambient conditions.

It is particularly preferred to apply the active components to the fiber as a mixture. When using the partially amidated polyethyleneimine in combination with potassium n-hexyl phosphate or potassium n-octyl phosphate, one obtains a clear aqueous solution at concentrations of up to 15% or more (combined weight of the two active components).

The following examples, except for the controls, are illustrative of the invention and are not intended as limiting.

EXAMPLE 1

To a clean glass mixing vessel were added in order 80.18 parts by weight of demineralized water, 16.07 parts by weight of 70% potassium n-octyl phosphate solution, and 3.75 parts by weight of partially amidated polyethyleneimine made according to Examples 1–4 of U.S. Pat. No. 3,597,265 (amine value of 340–420). The mixture was warmed to 35°–40° C. and agitated for about 15 minutes until a clear 15% solution resulted. The solution pH was 10.23.

EXAMPLE 2—Control

To a clean mixing vessel were added, in order, 85 parts by weight of demineralized water and 15 parts by weight of the partially amidated polyethyleneimine of Example 1. After mixing for about 15 minutes, a clear solution resulted. The solution was then diluted to 0.25% concentration with demineralized water.

EXAMPLE 3—Control

To a clean mixing vessel were added in order 80 parts by weight of demineralized water and 20 parts by weight of 75% potassium lauryl phosphate solution. The mixture was agitated for about 15 minutes until a uniform, milky, opaque 15% emulsion resulted. Aliquots of this emulsion were diluted to 0.75% and 1.0% concentrations with demineralized water.

EXAMPLE 4—Control

To a clean mixing vessel were added in order 78.6 parts by weight of demineralized water and 21.4 parts by weight of 70% potassium n-octyl phosphate solution. The mixture was agitated for about 15 minutes until a uniform, milky, opaque 15% dispersion resulted. Aliquots of this dispersion were then diluted to 0.75% and 1.0% concentrations with demineralized water.

EXAMPLE 5—Control

To a clean mixing vessel were added in order 66.7 parts by weight of demineralized water and 33.3 parts by weight of 45% potassium hexyl phosphate solution. The mixture was agitated for about 15 minutes until a clear solution resulted. Aliquots of this solution were then diluted to 0.75% and 1.0% concentrations with demineralized water.

EXAMPLE 6

Finish solution as made in Example 1 was diluted to 1% concentration with demineralized water, and 5 grams of this solution was added to a beaker containing 5 grams of 1.5 denier, 1½ inch, aramid staple (Type E-34 Nomex® made according to U.S. Pat. No. 4,668,234. The staple and finish solution were kneaded with a glass stirring rod for about 5 minutes to distribute the finish solution uniformly on the fibers, and the staple fiber dried immediately after the kneading step using a dryer at a temperature of 130° C. and a drying time of 10 minutes.

EXAMPLE 7—CONTROL

Finish emulsion as made in Example 3 was applied to aramid staple as in Example 6.

EXAMPLE 8—CONTROL

Finish dispersion as made in Example 4 was applied to aramid staple as in Example 6.

EXAMPLE 9—CONTROL

Finish solution as made in Example 5 was applied to aramid staple as in Example 6.

EXAMPLE 10

Finish solution as made in Example 2 was applied to aramid staple by adding 5 grams of 0.25% finish solution to 5 grams of aramid staple in a beaker, kneading for 5 minutes and drying immediately for 10 minutes at 130° C. This staple was then placed in a beaker, 5 grams of 0.75% finish emulsion from Example 3 was added, the staple was kneaded for 5 minutes and dried for 10 minutes at 130° C.

EXAMPLE 11

Example 10 was repeated using 0.25% finish solution from Example 2 and 0.75% finish dispersion from Example 4.

EXAMPLE 12

Example 10 was repeated using 0.25% finish solution from Example 2 and 0.75% finish solution from Example 5.

TABLE 1

| Nomex® E-34 Staple as in Example | COMPILATION % By Weight of Finish on Fiber: Amidated PEI | Potassium Alkyl Phosphate C-18 | C-12 | C-8 | C-6 |
|---|---|---|---|---|---|
| 6* | 0.25 | — | — | 0.75 | — |
| 7* | — | — | 1.0 | — | — |
| 8* | — | — | — | 1.0 | — |
| 9* | — | — | — | — | 1.0 |
| 10** | 0.25 | — | 0.75 | — | — |
| 11** | 0.25 | — | — | 0.75 | — |
| 12** | 0.25 | — | — | — | 0.75 |

*Finish applied with kneading and drying done immediately after kneading for 10 minutes at 130° C.
**Used dual application. Partially amidated PEI applied first, fiber then dried at 130° C. for 10 minutes, phosphate applied and fiber dried again at 130° C. for 10 minutes.

EXAMPLE 13

Staple samples prepared in Examples 6–14 were converted to short lengths of sliver using a RotorRing Model 580 manufactured by Spinlab. The electrical resistivity of the sliver samples were determined using the method described for sliver in the literature (Thomas J. Proffitt, Jr., "Surfactants as Textile Antistatic Agents", in *Proceedings of Session Lectures and Scientific Presentations on ISF-JOCS World Congress*, Vol. II, p. 699, The Japan Oil Chemists' Society, Tokyo). Results are in Table 2 for resistivities expressed as their logarithms, Log R. Log R values were measured at 47% relative humidity and repeat measurements were made as sliver was aged. According to S. P. Hersch (*DECHEMA Monogr.* 72:199 (1974)) Log R Values of 10 or less indicate excellent static protection.

TABLE 2

Log R Versus Age After Finish Application

| Example | Log R Initial | Log R Aged | Number of Days Aged |
|---|---|---|---|
| 6 | 8.90 | 9.90 | 83 |
| 7 | 10.83 | 13.70 | 83 |
| 8 | 9.51 | 11.77 | 61 |
| 9 | 9.10 | 13.53 | 61 |
| 10 | 9.33 | 10.89 | 79 |
| 11 | 8.59 | 9.42 | 79 |
| 12 | 7.79 | 10.18 | 79 |

EXAMPLE 14

Finish as made in Example 1 was applied to two types of MPD-I 1.5 dpf tow Type E-34 carrierless-dyeable Nomex® aramid tow and Type E-504 carrierless-printable Nomex® aramid tow by passing the tow in contact with two Baber applicators (U.S. Pat. No. 3,422,796), one above and one below the tow band. Samples were made with three finish flow rates for each of the tow products. The tow samples were then placed in tow cans and moved immediately (~20 minutes lag time) to a drum dryer where they were dried at 110°–140° C. The tow samples were then cut to 1½ inch staple using a Lummus cutter. Staple was processed on a chute-fed, roller-takeoff, cotton-system card with acceptable electrostatic charging when finish level was 0.2% on-weight-of-fiber or higher, and fiber cohesion was improved. Finish level changed very little with age as shown in Table 3, and electrostatic charging and Log R change very little with age as shown in Table 4. Cohesion as measured by card sliver tenacity in milligrams/denier ranged from 2.46 to 3.84 for fiber with the finish from Example 1 versus 1.43 to 1.83 for fiber with a control finish, potassium lauryl phosphate. This improves card web stability.

TABLE 3

Finish on Fiber Level Versus Fiber Age

| Example | Nomex® Type | % Finish on Fiber: After Dryer | Card Sliver 13 Days Old | Card Sliver 53 Days Old |
|---|---|---|---|---|
| A | E-34 | 0.15 | 0.15 | — |
| B | E-34 | 0.25 | 0.29 | 0.35 |
| C | E-34 | 0.31 | 0.38 | — |
| D | E-504 | 0.27 | 0.22 | 0.28 |
| E | E-504 | 0.49 | 0.40 | 0.59 |
| F | E-504 | 0.83 | 0.66 | 0.85 |

TABLE 4

| Sample | Carding Static and Log R Versus Age | | | |
|---|---|---|---|---|
| | Carding Static | | Card Sliver Log R | |
| | 13 Days Old | 47 Days Old | 13 Days Old | 47 Days Old |
| A | −2400 to +1000 | — | 9.99 | — |
| B | 0 | −200 +80 | 8.58 | 8.86 |
| C | 0 | — | 8.17 | — |
| D | −5 to +5 | −200 to +500 | 9.28 | 9.06 |
| E | 0 | 0 | 8.27 | 8.43 |
| F | 0 | 0 | 7.83 | 7.97 |

I claim:

1. Substantially amorphous surfactant containing poly(m-phenylene isophthalamide) fiber of reduced static propensity, said fiber having a two-component coating, said coating comprising from 65 to 90% by weight of potassium $C_6$–$C_{18}$ alkyl phosphate and from 10 to 35% by weight of a partially amidated polyalkyleneimine on its surface, said coating being present in an amount of at least about 0.2% based on the weight of the fiber.

2. A fiber according to claim 1 wherein the phosphate is potassium n-octyl phosphate.

3. A method for preparing the fiber of claim 1 comprising applying the two-component coating to the fiber as a mixture of the components or in sequence with drying after application of each component.

4. An antistatic finish for dyeable, surfactant-containing poly(m-phenylene isophthalamide) fiber comprising an aqueous solution of a mixture of (a) potassium n-hexyl or (B) potassium n-octyl phosphate and a partially amidated polyalkyleneimine, said mixture comprising from 65 to 90 weight percent of phosphate and from 10 to 35 weight percent of polyalkyleneimine.

* * * * *